United States Patent [19]

Beauch

[11] 4,157,854

[45] Jun. 12, 1979

[54] STEERING COLUMN ELECTRICAL CONNECTOR ARRANGEMENT

[75] Inventor: Howard D. Beauch, Hemlock, Mich.

[73] Assignee: General Motors Corporation, Detroit, Mich.

[21] Appl. No.: 898,912

[22] Filed: Apr. 21, 1978

[51] Int. Cl.[2] ..... H01R 39/00

[52] U.S. Cl. ..... 339/3 S; 200/61.56; 339/5 M; 339/88 R

[58] Field of Search ..... 200/61.56; 339/35 R, 339/88 R, 5 R, 5 M

[56] References Cited

U.S. PATENT DOCUMENTS

| | | | |
|---|---|---|---|
| 3,525,536 | 8/1970 | Pruneski | 339/3 S |
| 3,876,272 | 4/1975 | Tsutsumi et al. | 339/5 R |
| 4,063,789 | 12/1977 | Kreisl | 339/3 S |

*Primary Examiner*—Roy Lake
*Assistant Examiner*—DeWalden W. Jones
*Attorney, Agent, or Firm*—Edward J. Biskup

[57] ABSTRACT

An electrical connector arrangement for a motor vehicle steering assembly which includes a stationary steering column member rotatably supporting a steering shaft fixed with a steering wheel and characterized in that the steering column member supports a pair of concentric metallic rings that are adapted to be electrically connected to a sensor that forms a part of an occupant restraint cushion system. Each of the rings supports a plurality of contact brushes which cooperate with a pair of annular conductor members connected to the steering shaft for continuously providing electrical current to the occupant restraint system.

3 Claims, 3 Drawing Figures

STEERING COLUMN ELECTRICAL CONNECTOR ARRANGEMENT

This invention relates to a steering wheel occupant restraint cushion system and more particularly concerns an electrical connector arrangement for such system that is interposed between the steering column and the steering shaft for allowing relative movement therebetween while at the same time providing continuous electrical continuity between a sensor and an occupant restraint cushion mounted in the steering wheel.

More specifically, the electrical connector arrangement according to the invention is combined with a motor vehicle steering assembly which includes a steering column member that rotatably supports a steering shaft. A steering wheel is mounted on the steering shaft and has an occupant restraint cushion mounted therein provided with a gas generator which is actuated under predetermined conditions by a sensor on the vehicle. The electrical connector arrangement is interposed between the steering column and the steering shaft for allowing relative rotational movement therebetween while continuously providing electrical continuity between the sensor and the gas generator of the occupant restraint cushion. The electrical connector arrangement includes a stationary insulator member that has a base wall in the form of an annulus with integral inner and outer concentric side walls and is fixed with the steering column member. An annular support member projects outwardly from the base wall between the side walls and lies on a circle that is concentric to the side walls. A pair of metallic rings are mounted on the opposite sides of the support member and are adapted to be electrically connected to the sensor. Each of the rings supports a plurality of contact brushes that extend at an angle towards the adjacent side wall and engage a pair of annular conductor members mounted on a carrier member which is fixed with the steering shaft. The conductor members are located in intersecting planes when viewed in cross section, and continuously maintain engagement with the contact brushes during rotation of the steering shaft so as to provide electrical current to the occupant restraint system upon operation of the sensor.

The objects of the present invention are to provide a new and improved electrical connector assembly for a motor vehicle steering wheel occupant restraint cushion system that uses a pair of concentric conductor members that are fixed with the shaft portion of the steering wheel and cooperate with a plurality of flexible brush-like contact members connected to the stationary steering column for providing electrical continuity between a sensor and a gas generator which forms a part of the occupant restraint cushion; to provide a new and improved contact arrangement for maintaining electrical continuity between relatively rotatable members and includes a pair of concentric conductor members continuously engaging a plurality of circumferentially spaced contact members wherein the conductor members are located in intersecting planes when viewed in cross section and each contact member is formed from a plurality of individual wires; and to provide a new and improved electrical connection between relatively rotatable members wherein one of the members is a steering wheel shaft that is connected through a carrier member to a pair of spaced concentric conductor members and the other member is a stationary steering column that fixedly supported a pair of concentric rings having a plurality of circumferentially spaced brush-like contact members.

Other objects of the invention will be more apparent from the following detailed description when taken with the drawings in which.

Figure 1:
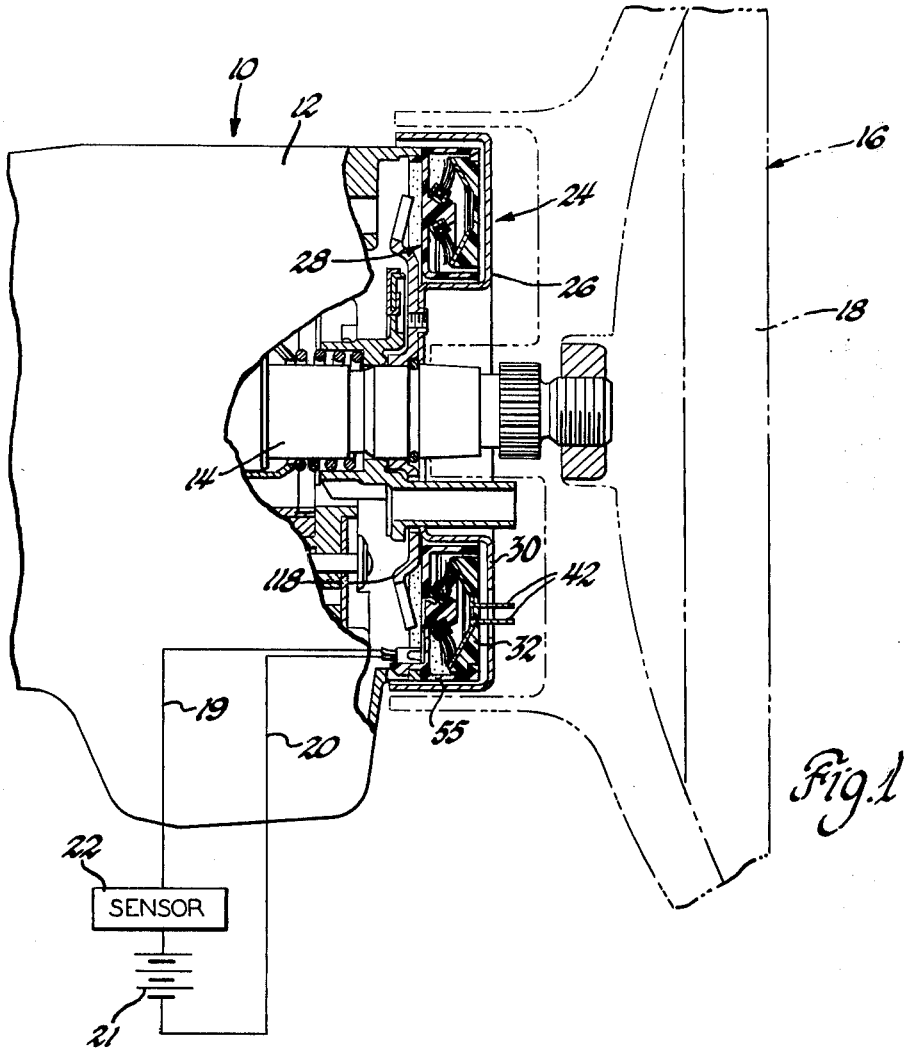
FIG. 1 is a schematic diagram of a steering column assembly having an electrical connector arrangement made according to the invention.

Referring to the drawings and more particularly to FIG. 1, a motor vehicle steering assembly 10 is shown which includes the usual fixed steering column member 12 which rotatably supports a steering shaft 14 having the upper end thereof fixed with a steering wheel 16. The steering wheel 16 supports an occupant restraint cushion 18 that is shown schematically and which is adapted to be electrically connected through conductors 19 and 20 with a battery 21 and a sensor 22. An electrical connector arrangement 24 that is incorporated in the steering column member 12 serves to provide electrical continuity between the sensor 22 and a gas generator (not shown) in the occupant restraint cushion 18 at all times while allowing the steering wheel to be rotated relative to the steering column member 12.

Figure 2:
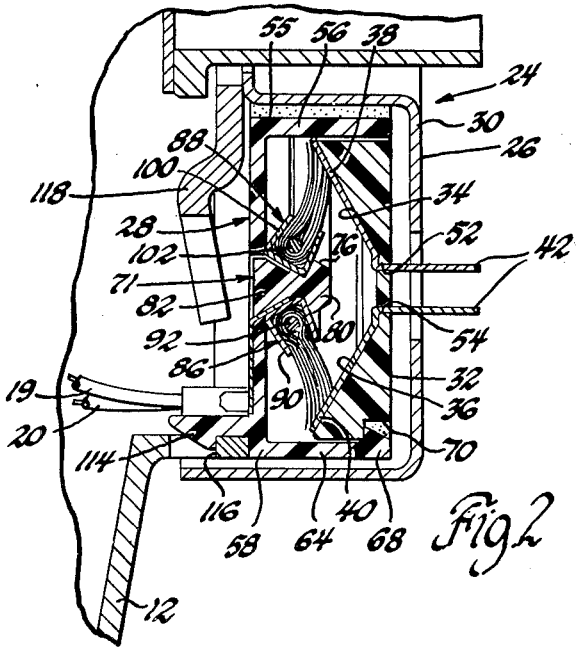
FIG. 2 is an enlarged sectional view of the electrical connector arrangement incorporated with the steering assembly shown in FIG. 1.
Figure 3:
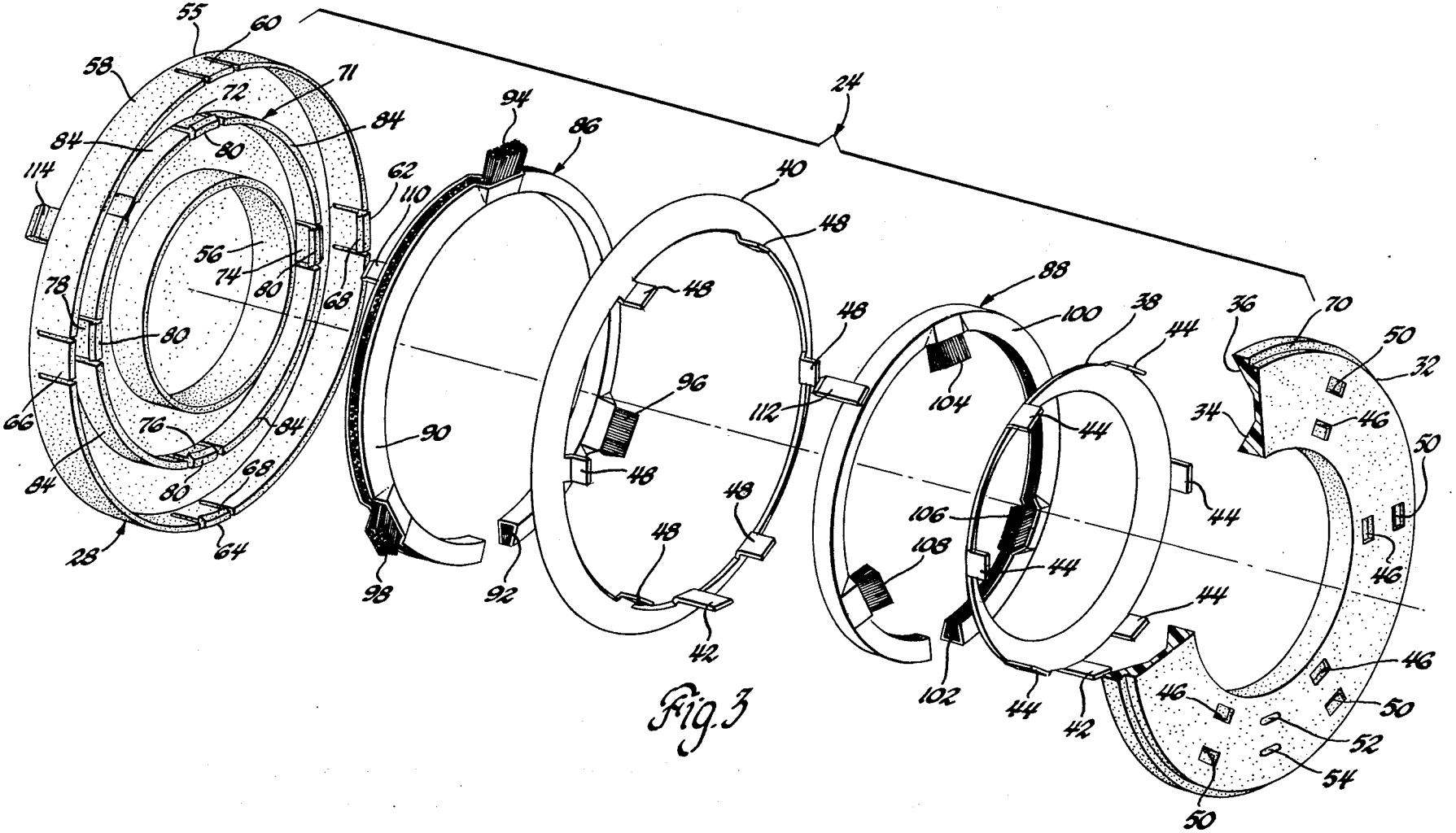
FIG. 3 shows the various parts of the electrical connector assembly in a perspective view and separated from each other.

FIGS. 2 and 3 illustrate in detail the construction of the electrical connector arrangement 24 and, in this regard, it will be noted that a pair of annulus type support members are provided, one of which serves as a conductor support and is identified by reference numeral 26 and the other of which serves as the contact support and is identified by reference numeral 28. The conductor support member 26 includes a cover member 30 and a carrier member 32, the latter of which is made of a plastic material and is formed with a pair of concentric support surfaces 34 and 36 which lie in intersecting planes when viewed in cross section as seen in FIG. 2. A pair of concentric conductor members 38 and 40, made of an electric conducting material such as silver or copper, are respectively mounted on the support surfaces 34 and 36 of the carrier member 32 and each conductor member is integrally formed with a terminal portion 42 which is adapted to be connected to the gas generator incorporated with the occupant restraint cushion 18. The conductor members 38 and 40 have their contact surfaces located in intersecting planes and, as best seen in FIG. 3, the conductor member 38 is formed with a plurality of circumferentially equally spaced axially projecting tabs each of which is identified by the reference numeral 44. Each tab 44 is adapted to extend through an opening 46 provided in the carrier member 32 and is afterwards crimped over at its end so as to permit the conductor member to maintain a fixed position on the carrier member 32. As should be apparent the spacing between the tabs 44 is equal to the spacing between the openings 46 and the latter are located on a circle that has a diameter equal to the diameter of the circle the tabs 44 lie on.

Similarly, the conductor member 40 is integrally formed with a plurality of circumferentially equally spaced axially projecting tabs each of which is identified by the reference numeral 48 and lie on a circle having a diameter grater than the diameter of the circle that tabs 44 lie on. The tabs 48 are adapted to extend through openings 50 in the carrier member 32 and are afterwards crimped over at their ends so as to rigidly secure the conductor member 40 in the position shown in FIG. 2. The terminal 42 on conductor member 38 extends through an opening 52 in the carrier member 32 that is on the same circle as the openings 46, while the terminal 42 on the conductor member 40 extends through an opening 54 which is on the same circle at the openings 50.

The contact support member 28 inclues an insulator member 55 in the form of an annulus which is also made from a plastic material and is formed with integral inner and outer concentric wall members 56 and 58, respectively which serve to enclose the electrical connector arrangement 24 when assembled. The outer wall member 58 includes four identical integral tab members 60, 62, 64 and 66 that flex radially outwardly and then inwardly during assembly with the carrier member 32 so as to allow a finger 68 formed with each tab member to move into an annular notch 70 in the carrier member 32 and serve as holding means for preventing axial separation of the support members 26 and 28 while allowing relative rotation therebetween. The insulator member 55 also includes an annular mounting member 71 which is located midway between the walls 56 and 58 and includes four identical support tabs 72, 74, 76 and 78. As seen in FIG. 2, each support tab 72, 74, 76 and 78 is formed with a head portion 80 that connects with a body portion 82 and is located between a pair of identical arcuately formed segments, each identified by reference numeral 84, that lie on a circle concentric to the walls 56 and 58. The segments 84 together with the support tabs 72, 74, 76 and 78 together constitute the mounting member 71 which serves to non-rotatably support and properly position a pair of split ring members 86 and 88 relative to the conductor members 38 and 40.

The ring member 86 consists of an annular metallic base portion 90 which, as seen in FIGS. 2 and 3, is U-shaped in cross section so as to provide a channel which opens towards the wall 58 and in which a brass core 92 is embedded. The brass core 92 is coextensive with the base portion 90 and serves to electrically connect three identical contact members 94, 96, 98, the centers of which are equally spaced from each other about the circumference of the base portion. Each contact member 94, 96 and 98 is formed from a plurality of brass wires that are looped around the core 92, as best seen in FIG. 2, and extend laterally outwardly towards the wall 58 at a slight angle. The brass wires are retained within the channel of the base portion 90 by having the legs of the latter crimped towards each other as seen in FIG. 3 in a manner so as to cause the angled relationship between the contact member and the plane of the base portion 90.

The ring member 88 is similar in construction to the ring member 86 except that its base portion 100 is of smaller diameter and has the channel formed therein opening towards the wall 56. As in the case with the ring member 86, the ring member 88 has a brass core 102 which electrically connects three contact members 104, 106 and 108 each of which consists of a plurality of brass wires that extend at a slight angle towards wall 56 and are held in position by crimping the legs of the base portion 100.

The respective ring members 86 and 88 are rigidly formed with terminals 110 and 112 that extend through suitable openings in the insulator member 55 and are adapted to be connected to conductors 19 and 20 which lead to the battery 21 and sensor 22. Thus, when the ring members 86 and 88 are located on the opposite sides of mounting member 71, the head portion 80 of the support tabs 72, 74, 76 and 78 serve to hold the ring members in place. As should be apparent, the ring members 86 and 88 can be assembled to the mounting member 71 because of the split design which allows radial flexing of the ring members during installation.

At this juncture, it will be noted that the insulator member 55 of the contact support member 28 is formed with a plurality of retainer tabs located adjacent to the wall 58. Although only one retainer tab is shown and identified by reference numeral 114, the retainer tabs are spaced uniformly about the circumference of the wall 58 and are adapted to flex inwardly towards the center of the annulus when being installed into the steering column member 12 and afterwards having a portion extend into an opening 116 in the column. In this manner, the contact support member 28 is non-rotatably secured to the steering column member 12.

The conductor support member 26 is fixed to the steering shaft 14 through the cover member 30. In this regard, it will be noted that the cover member 30 is rigid with a lock plate 118 which is non-rotatably secured to the steering shaft 14. Also, although not shown, the cover member 30 is formed with suitable means which cooperate with the carrier member 32 so that the two members rotate as a unit relative to the contact support member 28 upon rotation of the steering shaft 14. During such relative rotation, the contact members of the ring member 86 and 88 continuously engage the conductor members 38 and 40 and thereby maintain an electrical connection between the sensor 22 and the restraint cushion 18 so that upon operation of the sensor, the gas generator can be activated for deploying the cushion within the steering wheel 16.

Various changes and modifications can be made in this construction with departing from the spirit of the invention. Such changes and modifications are contemplated by the inventor and he does not wish to be limited except by the scope of the appended claims.

The embodiments of the invention in which an exclusive property or privilege is claimed are defined as follows:

1. In combination with a motor vehicle steering assembly including a steering column member rotatably supporting a steering shaft fixed with a steering wheel having an occupant restraint cushion, said vehicle having a sensor for actuating said occupant restraint system, an electrical connector arrangement interposed between said steering member column and said steering shaft for allowing relative movement therebetween while continuously providing electrical continuity between said sensor and said occupant restraint cushion, said electrical connector arrangement comprising a stationary annular insulator member carried by said steering column member and formed with inner and outer concentric side wall, mounting means formed with said stationary insulator member between the side walls and lying on a circle that is concentric to the side walls, a pair of metallic rings located on opposite sides of said mounting means and adapted to be electrically connected to said sensor, each of said rings supporting a plurality of contact brushes that extend laterally towards the adjacent side wall, and a pair of annular conductor members fixed with the steering shaft and being located in intersecting planes when viewed in cross section for continuously maintaining engagement with the contact brushes during rotation of said steering shaft so as to provide current to said occupant restraint system upon operation of said sensor.

2. In combination with a motor vehicle steering assembly including a steering column member rotatably supporting a steering shaft fixed with a steering wheel having an occupant restraint cushion, said vehicle having a sensor for actuating said occupant restraint system, an electrical connector arrangement interposed between said steering member column and said steering shaft for allowing relative movement therebetween while continuously providing electrical continuity between said sensor and said occupant restraint cushion, said electrical connector arrangement comprising a stationary annular insulator member carried by said steering column member and formed with inner and outer concentric side walls, mounting means formed with said stationary insulator member between the side walls and lying on a circle that is concentric to the side walls, said mounting means including a plurality of support tabs each formed with a head portion connected to a body portion, a pair of concentric metallic ring members mounted on opposite sides of said mounting means and adapted to be electrically connected to said sensor, each of said ring members supporting a plurality of uniformly spaced contact brushes that extend laterally towards the adjacent side wall, and a pair of annular conductor members fixed with the steering shaft and being located in intersecting planes when viewed in cross section for continuously maintaining engagement with the contact brushes during rotation of said steering shaft so as to provide current to said occupant restraint system upon operation of said sensor.

3. In combination with a motor vehicle steering assembly including a steering column member rotatably supporting a steering shaft fixed with a steering wheel having an occupant restraint cushion, said vehicle having a sensor for actuating said occupant restraint system, an electrical connector arrangement interposed between said steering column member and said steering shaft for allowing relative movement therebetween while continuously providing electrical continuity between said sensor and said occupant restraint cushion, said electrical connector arrangement comprising a stationary annular insulator member carried by said steering column member and formed with inner and outer concentric side walls, mounting means integrally formed with and projecting outwardly from said stationary insulator member between the side walls and lying on a circle that is concentric to the side walls, a pair of concentric metallic split rings mounted on opposite sides of said support means and adapted to be electrically connected to said sensor, each of said rings supporting a plurality of contact brushes that extend laterally towards the adjacent side wall, a conductor support member fixed with the steering shaft, said conductor support member including a cover member and a carrier member, a pair of concentric support surfaces formed in said carrier member and lying in intersecting planes when viewed in cross section, and a pair of annular conductor members fixed with the carrier member and mounted on said support surfaces for continuously maintaining engagement with the contact brushes during rotation of said steering shaft so as to provide current to said occupant restraint system upon operation of said sensor.

* * * * *